US007389072B2

(12) United States Patent
Hebner et al.

(10) Patent No.: US 7,389,072 B2
(45) Date of Patent: Jun. 17, 2008

(54) REDUCING ADHESION OF TONER TO METERING DEVICES

(75) Inventors: JoAnn Whitney Hebner, Lexington, KY (US); Royden Thomas Kern, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 180 days.

(21) Appl. No.: 11/359,109

(22) Filed: Feb. 22, 2006

(65) Prior Publication Data

US 2007/0196137 A1 Aug. 23, 2007

(51) Int. Cl.
*G03G 15/08* (2006.01)

(52) U.S. Cl. ..... 399/260

(58) Field of Classification Search ..... 399/258, 399/260, 262, 263
See application file for complete search history.

(56) References Cited

U.S. PATENT DOCUMENTS 6,510,291 B2 * 1/2003 Campbell et al. ..... 399/27

* cited by examiner

*Primary Examiner*—Hoang Ngo
(74) *Attorney, Agent, or Firm*—Ronald K. Aust

(57) ABSTRACT

A device and method for storing toner within an image forming apparatus having an upper reservoir and a lower toner reservoir. A pass through region between the reservoirs may journal a rotatable metering bar. The bar may include convex depressions to dispense toner from the upper to the lower reservoir. The convex shape reduces the toner adherence to the bar, particularly in the case of chemically polymerized toner.

19 Claims, 10 Drawing Sheets

REDUCING ADHESION OF TONER TO METERING DEVICES

BACKGROUND

The present invention is directed to an image forming apparatus and, more particularly, to an image forming apparatus having a meter for moving toner from an upper toner supply reservoir to a lower toner supply reservoir.

Image forming devices including copiers, laser printers, facsimile machines, and the like, include a photoconductive drum (hereinafter photoconductor) having a rigid cylindrical surface that is coated along a defined length of its outer surface. The surface of the photoconductor is charged to a uniform electrical potential and then selectively exposed to light in a pattern corresponding to an original image. Those areas of the photoconductive surface exposed to light are discharged thus forming a latent electrostatic image on the photoconductive surface. A developer material, such as toner, having an electrical charge such that the toner is attracted to the photoconductive surface is used for forming the image. The toner is stored in a reservoir adjacent to the photoconductor and is transferred to the photoconductor by the developer roll. The thickness of the toner layer on the developer roll is controlled by a nip, which is formed between the doctor blade and the developer roll. A recording sheet, such as a blank sheet of paper, is then brought into contact with the discharged photoconductive surface and the toner thereon is transferred to the recording sheet in the form of the latent electrostatic image. The recording sheet is then heated thereby permanently fusing the toner to the sheet.

DETAILED DESCRIPTION

Figure 1:
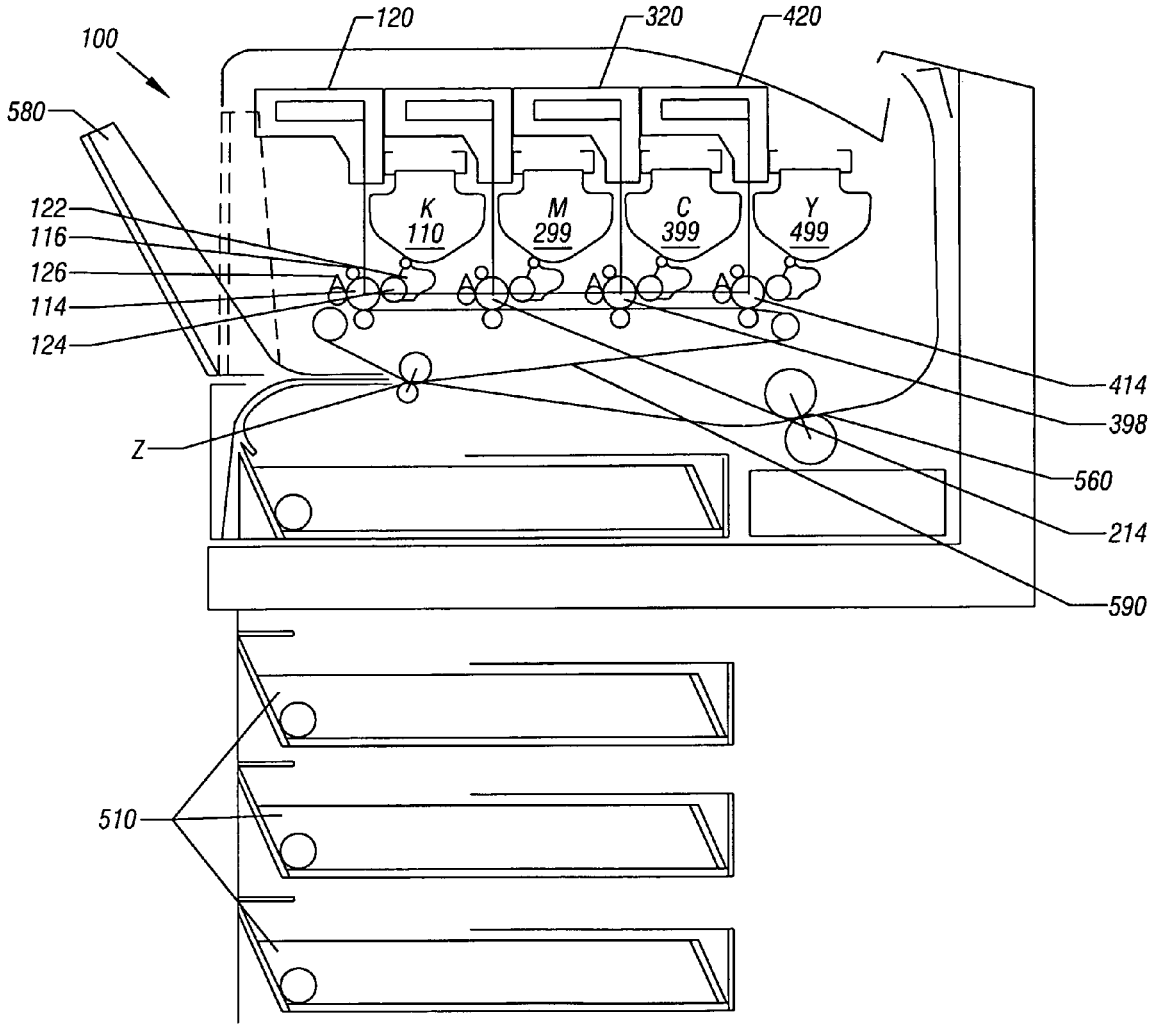
FIG. 1 is a side cut-away view illustrating the elements of an image-forming apparatus.

FIG. 1 illustrates the basic elements of an image forming apparatus and is incorporated for an understanding of the overall electrophotographic image forming process. A four cartridge color laser printer is illustrated as 100, however one skilled in the art will understand that the present invention is applicable to other types of image forming devices using toner for printing with a photoconductor. The image forming apparatus, generally designated 100, includes a plurality of similar toner cartridges 110, 299, 399, and 499. Each toner cartridge is of a similar construction but is distinguished by the toner color contained therein. In the preferred embodiment, the device includes a black (K) cartridge 110, a magenta (M) cartridge 299, a cyan (C) cartridge 399, and a yellow (Y) cartridge 499. Each different color toner forms an individual image of a single color that is combined in layered fashion to create the final multi-colored image.

Each of the toner cartridges is substantially identical and includes a photoconductor, a developer device, and a cleaning device. As the cartridges are identical except for the toner color, the cartridge and elements for forming black images will be described, with the other color image forming units being omitted for simplification.

The photoconductor 114 rotates past an adjacently-positioned intermediate transfer mechanism belt 590 (hereinafter, ITM belt) to which the toner is transferred from the photoconductor 114. As illustrated in FIG. 1, the ITM belt 590 is endless and extends around a series of rollers adjacent to the photoconductors. The ITM belt 590 and each photoconductor 114, 214, 398, 414 are synchronized providing for the toner from each photoconductor to precisely align on the ITM belt 590 during a single pass. By way of example as viewed in FIG. 1, the yellow toner will be placed on the ITM belt, followed by cyan, magenta, and black.

Figure 4:
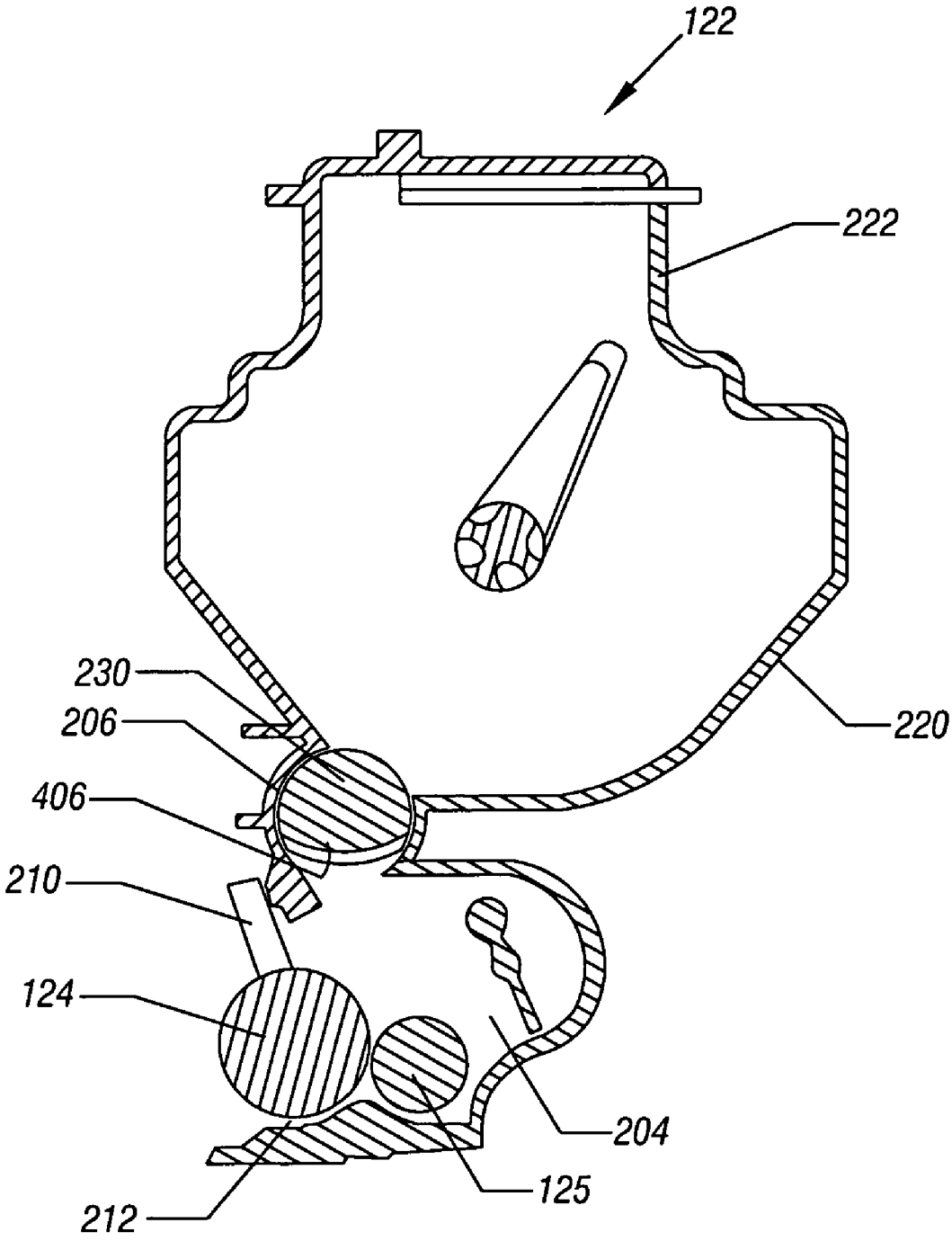
FIG. 4 is a cross section view of the toner reservoir constructed according to the present invention.

After receiving the latent image, the photoconductor 114 rotates to the developer which has a toner bin, illustrated generally as 122 in FIG. 1 and specifically as 204 in FIG. 4, for housing the toner and a developer roller 124 for uniformly transferring toner to the photoconductor. The toner is transferred from the toner bin 204 to the photoconductor 114 through a doctor blade nip 211 formed between the developer roller 124 and the doctor blade 210.

The toner is a fine powder usually constructed of plastic granules that are attracted and cling to the areas of the photoconductor 114 that have been discharged by the laser scanning assembly 120. In one embodiment the toner may be chemically polymerized toner (CPT). This toner may be stickier than conventional toners.

After depositing the toner on the ITM belt, the photoconductor 114 rotates through a cleaning area where residual toner is removed from the surface via a brush or scraper 126. The residual toner is moved along the length of the photoconductor 114 to a waste toner reservoir 109 where it is stored until the cartridge is removed from the image forming apparatus and disposed. In one embodiment, the photoconductor 114 further passes through a discharge area (not shown) having a lamp or other light source for exposing the entire photoconductor surface to light to remove any residual charge and image pattern formed by the laser.

As the photoconductors are being charged and gathering toner, a recording sheet, such as a blank sheet of paper, is being routed to intercept the ITM belt 590. The paper may be placed in one of the lower trays 510, or introduced into the image forming device through a side track tray 580. A series of rollers and belts transport the paper to point Z where the sheet contacts the ITM belt 590 and receives the toner. The sheet may receive an electrostatic charge prior to contact with the ITM belt to assist in attracting the toner from the belt. The sheet and attached toner next travel through a fuser 560 having a pair of rollers and a heating element that heats and fuses the toner to the sheet. The paper with fused image is then transported out of the printer for receipt by a user.

Each of the toner cartridges may be removed and replaced within the image forming apparatus. Replacement is usually necessary when there is no toner remaining within the cartridge. In an embodiment as illustrated in FIG. 1, the cartridges are side loading into the image forming device in a direction substantially perpendicular to the rotation of the ITM belt 590.

Figure 2:
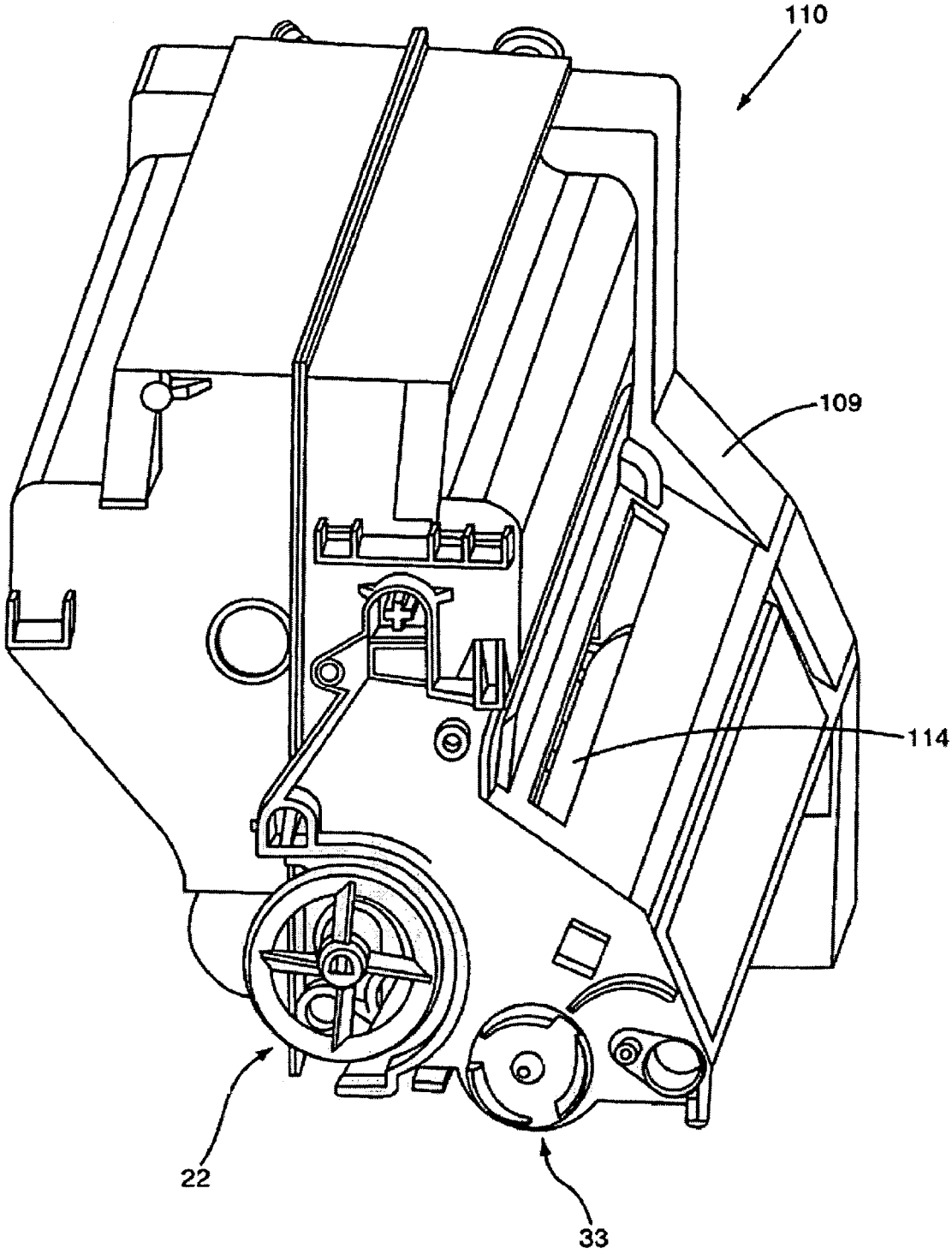
FIG. 2 is a perspective view illustrating the back side of a printer cartridge constructed according to the present invention.

FIG. 2 illustrates a rear view of a toner cartridge 110. The photoconductor 114 is positioned within the cartridge and includes a coupler 33 positioned on one end which intermeshes with the drive gears of the printer (not shown) for rotating the photoconductor 114 during the printing process. A second coupler 22 is also positioned on the back end of the cartridge and intermeshes with printer drive gears for agitating and moving the toner within the toner reservoir to contact the developer roller 124 for high quality printing. If the toner is not agitated and moved within the toner reservoir, the toner may become stuck within the reservoir requiring a new cartridge to be loaded into the printer. Alternatively, the toner may become blocked within the reservoir resulting in an inadequate amount of toner being transferred to the developer roller 124 and photoconductor 114 causing light or vague images to be printed, or worse, blank pages. In one embodiment, the toner cartridge 110 is side loading within the printer for easy installation and removal.

Figure 3:
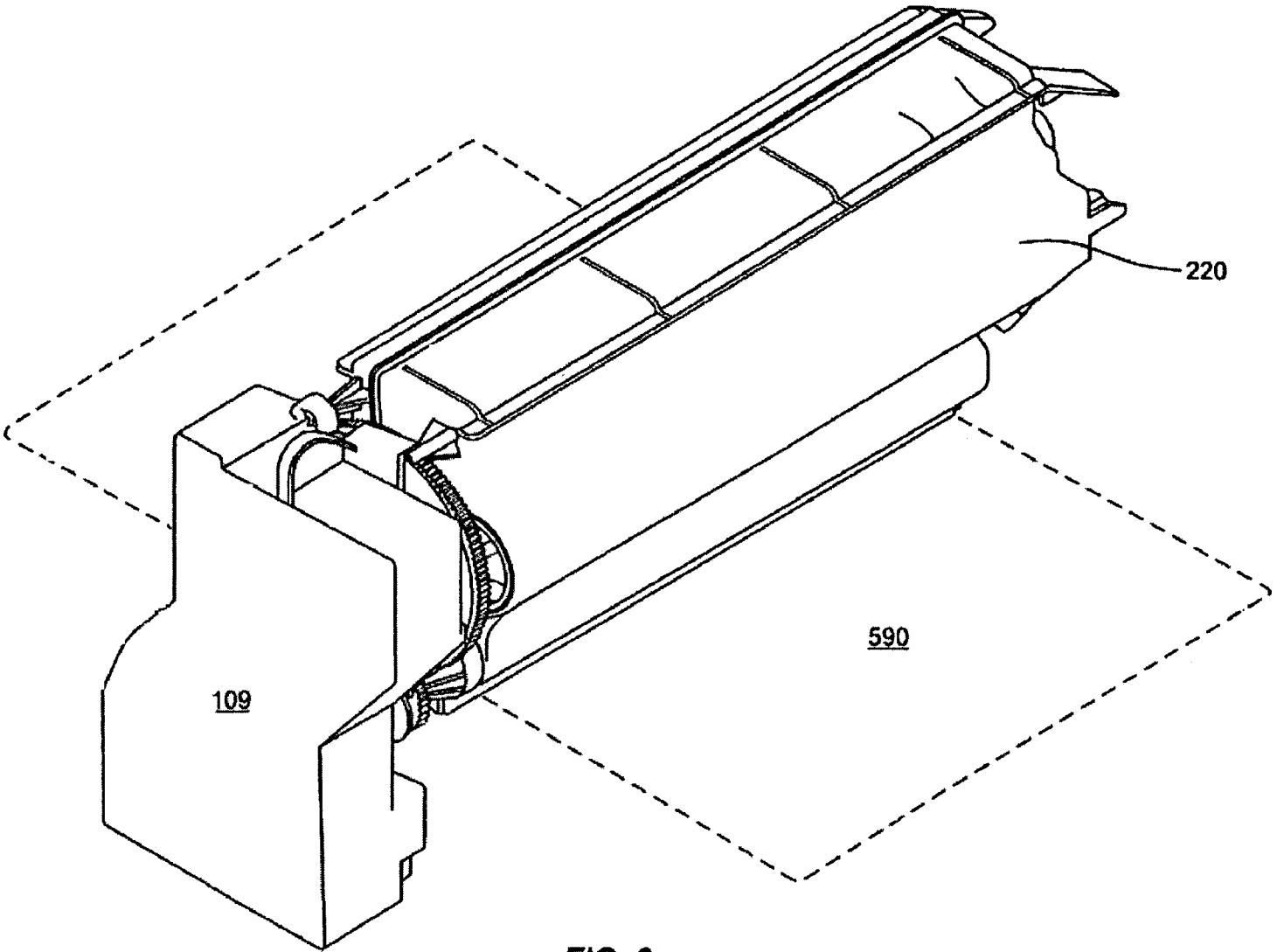
FIG. 3 is a partial perspective view of the printer cartridge positioned relative to the intermediate transfer belt.

The front end of the cartridge is illustrated in FIG. 3. The ITM belt 590 is placed in the drawing to illustrate the relative spacing and positioning of the cartridge within the printer. A toner bin housing 220 extends around the toner reservoir for containing the toner and preventing leakage that could result in print errors or come in contact with the user.

Toner is housed within the cartridge in a toner bin or toner supply reservoir 122 as illustrated in FIG. 4. The amount of toner stored within the cartridge is critical because a larger toner amount allows for more images to be produced before the toner is emptied and the cartridge is removed. However, a toner reservoir that is too large requires too much room within the printer 100 resulting in a large overall printer size. The toner reservoir 122 includes an upper sump area 222 and a lower sump area 204. A pass through region 206 is positioned between the upper and lower sump regions and provides a path for toner to move from the upper sump 222 to the lower sump 204. The lower sump area 204 includes the developer roller 124 for transferring toner to the photoconductor 114. A doctor blade 210 is positioned in contact with the developer roller 124 for controlling the amount of toner developed to the photoconductor 114. The doctor blade 210 preferably forms an outer edge of the lower sump region 204 as illustrated in FIG. 4, however, the doctor blade may be contained within the walls of the lower sump region. A seal 212 extends from the edge of the lower sump region to the developer roller 124 to prevent toner leakage.

The upper sump region 222 holds a larger amount of toner than the lower sump region 204 in one embodiment. This provides for a larger overall volume of the toner reservoir 122 without placing pressure on a doctor blade nip formed between the doctor blade 210 and the developer roller 124. If too much toner is positioned against the doctor blade 210, inconsistent amounts of toner may be transferred from the developer roller 124 to the photoconductor 114 resulting in poor print quality and print errors. Isolating the lower sump region 204 from the larger amount of toner contained in the upper sump region 222 controls the amount of pressure on the opening between the doctor blade 210 and developer roller 124 and reduces or eliminates print errors caused by excessive toner passing between the doctor blade 210 and developer roller 124. The upper sump region 222 may be positioned vertically above the lower sump region 204. This provides for gravity to assist in moving the toner from the upper sump region 222 to the lower sump region 204. This orientation also provides for the toner reservoir to be positioned within cartridge space required for the focal distance between the laser printhead 120 and the photoconductor 114.

Figure 5:
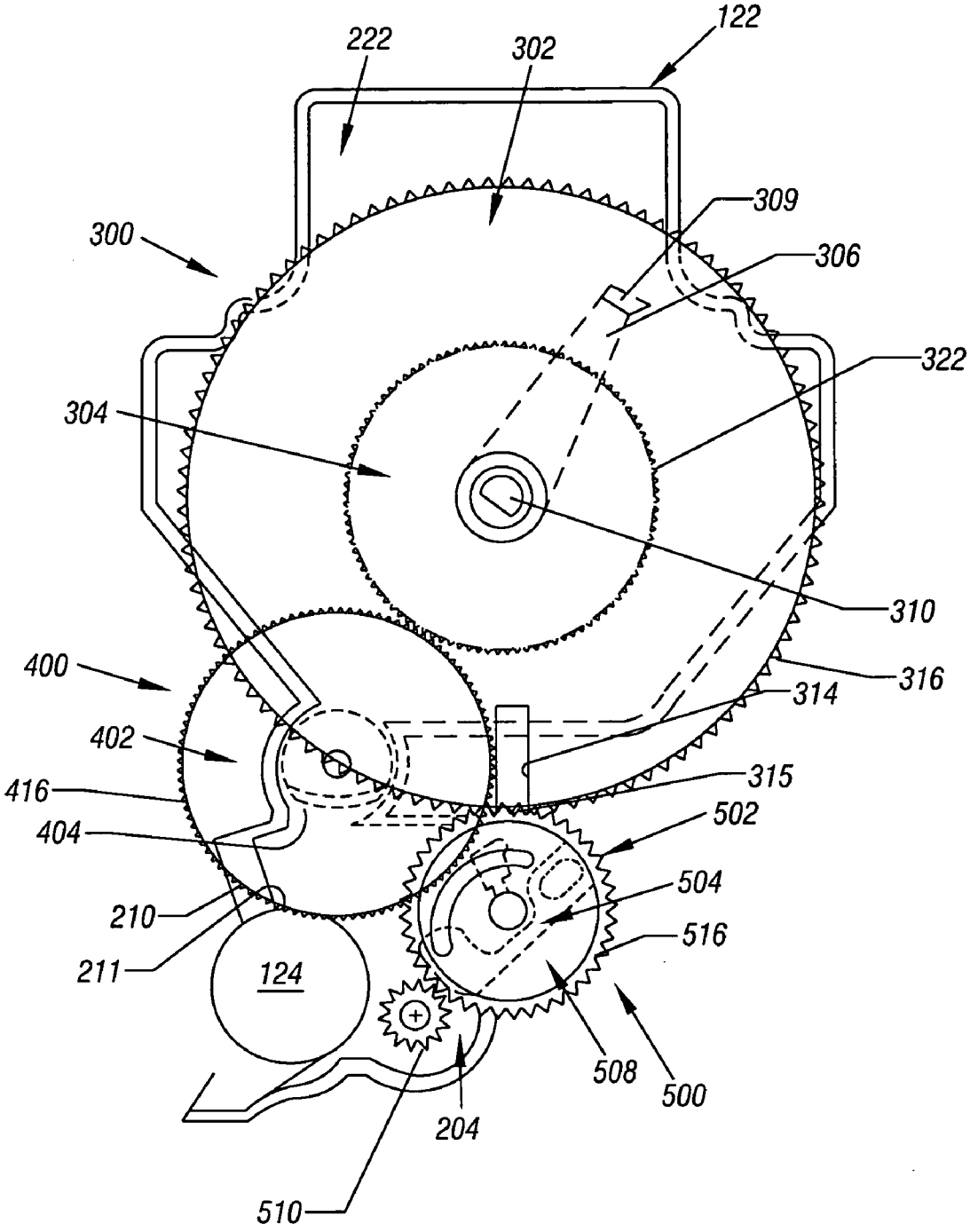
FIG. 5 is an end view of the toner reservoir and gear mechanisms for sensing the amount of toner within the lower reservoir and transferring toner from the upper reservoir to the lower reservoir.
Figure 6:
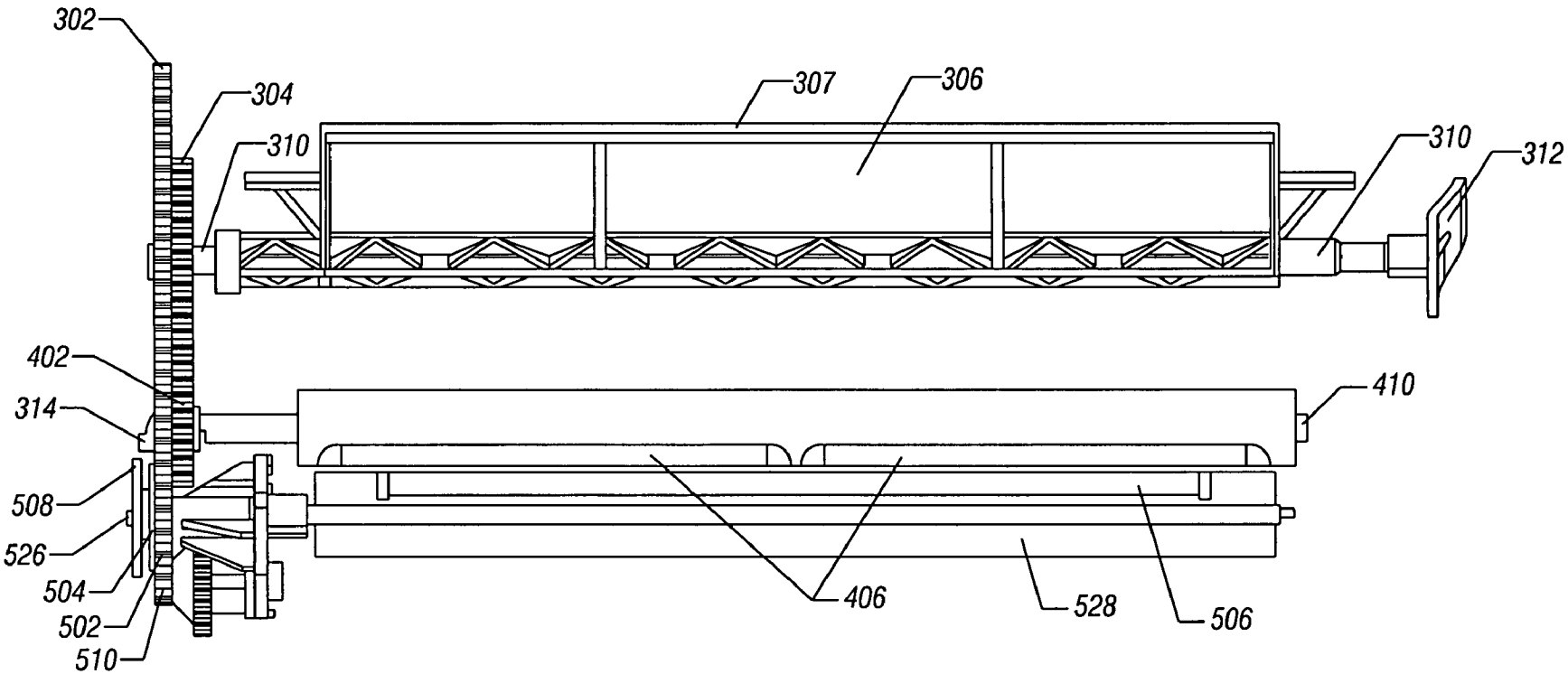
FIG. 6 is a side view illustrating the alignment of the gear mechanisms.
Figure 7:
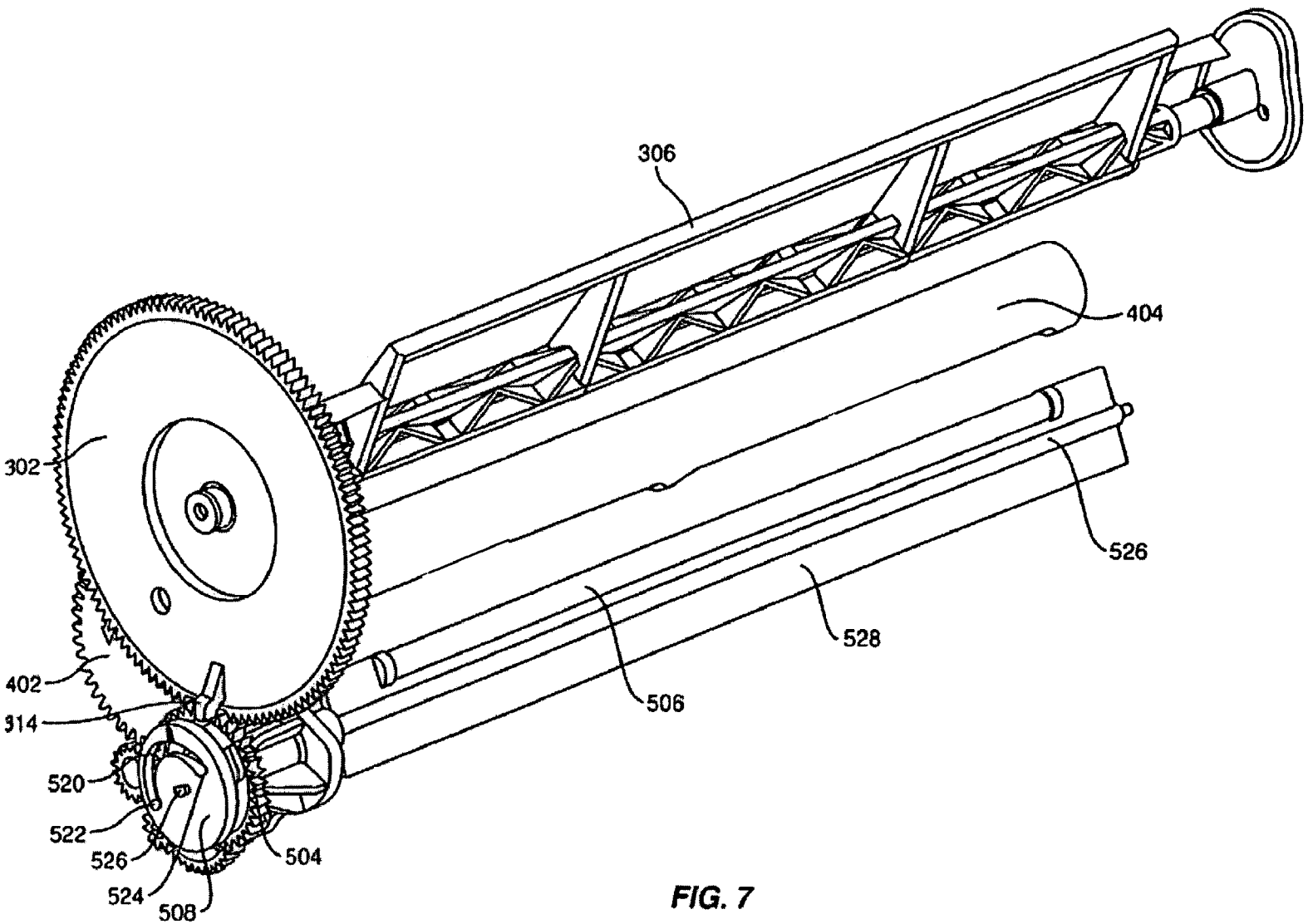
FIG. 7 is a perspective view illustrating of the toner sensing and transferring mechanisms.

The mechanisms for moving the toner from the upper sump region 222 to the lower sump region 204 are illustrated in FIGS. 5-7. These include a toner supply mechanism 300 within the upper sump region 222 for agitating and moving the toner from the upper sump region 222 to the lower sump region 204. A toner sensor mechanism 500 is positioned in the lower sump region 204 for determining the amount of toner within the lower sump 204 and engaging the toner supply mechanism 300 once that level reaches a predetermined amount. A metering mechanism 400 functions to move a specific amount of toner from the upper sump region 222 to the lower sump region 204.

The toner supply mechanism 300 functions to agitate the toner within the upper sump region 222 and move the toner to the metering mechanism 400. The toner within the upper sump region 222 may become packed together and unable to be fed through the toner reservoir ultimately to the photoconductor 114. As illustrated in FIG. 5, the toner supply mechanism 300 includes toner supply gears having a larger outer gear 302 and an inner gear 304. Preferably, the gears 302, 304 are integrally connected. The outer gear 302 and inner gear 304 are both mounted on a central axle 310 that extends through the upper sump region 222 of the cartridge. The outer gear 302 and inner gear 304 are both fixedly attached to the axle 310 thereby rotation of one of the gears results in rotation of both gears.

Figure 8:
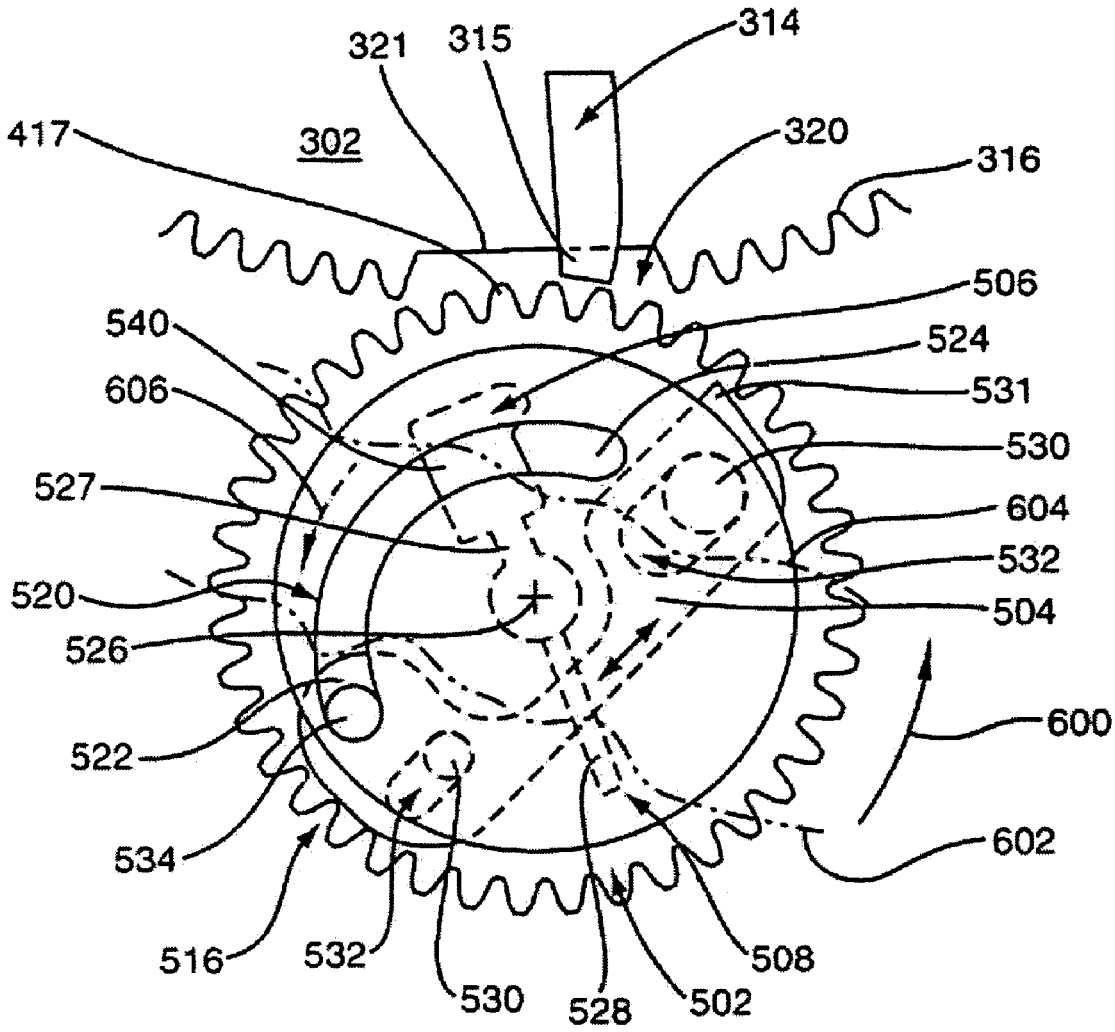
FIG. 8 is an enlarged side view illustrating the interaction between the toner sensor mechanism and the toner supply gears.

The inner gear 304 has a smaller diameter than the outer gear 302 and includes inner gear teeth 322 positioned around the circumference. The outer gear 302 includes teeth 316 positioned about the circumference except for an opening 320 that has no teeth. Opening 320 (FIG. 8) includes an edge positioned nearer to the center of the gear than the inner edges of the gear teeth 316. As illustrated in FIGS. 5 and 8, a dogleg 314 is fixedly mounted to the outer gear 302 and extends into the opening 320. The end 315 of the dogleg 314 extends into the opening 320 a distance less than the outer edge of the gear teeth 316.

FIG. 6 illustrates a side view of the toner supply mechanism. The wall of the developer housing 220 has been removed from FIG. 6 for clarification purposes. The developer housing 220 is placed between the inner gear 304 and paddle 306 such that inner and outer gears 304, 302 do not contact the toner. Likewise on the opposite side, the developer housing 220 is positioned between the paddle 306 and cam 312.

The paddle 306 extends substantially the width of the upper sump region 222. The size of the paddle 306 is such that during rotation the outer edge 307 comes within close proximity to the inner walls of the upper sump region 222 for agitating the toner and preventing toner clumping or sticking. The paddle 306 may have a variety of orientations including substantially straight, or including an outer wing 309 substantially perpendicular to the paddle 306 as illustrated in FIG. 5.

The metering mechanism, generally designated 400, is positioned between the upper sump 222 and lower sump 204 regions for moving toner therebetween. As illustrated in FIG. 5, the meter mechanism 400 is substantially aligned with the pass-through region 206 and includes a meter gear 402 having a meter measuring bar 404. Meter gear 402 includes teeth 416 that extend about the circumference. In one embodiment, the meter gear 402 is of the same size as inner gear 304 and has the same number of teeth, therefore, one rotation of the inner gear 304 results in one complete revolution of the meter gear 402. A meter measuring bar 404 is aligned with the meter gear 402 about a central axle 410. The meter measuring unit 404 includes meter depressions 406 for collecting and transferring toner from the upper sump region 222 to the lower sump region 204.

FIG. 6 illustrates the alignment and spacing of the meter mechanism 400 relative to the other mechanisms for sensing and moving toner. The developer housing 220 extends between the meter gear 402 and meter measuring bar 404 such that the gear does not contact the toner. The meter gear 402 is positioned within the same plane as the inner supply gear 304 and the meter gear teeth 416 intermesh with the inner gear teeth 322. The meter measuring bar 404 is preferably generally cylindrical having meter depressions 406 positioned along the length. The bar 404 is journaled within a pass through region 206. The region 206 and the bar 404 may have substantially the same diameters, those being an inside diameter in the case of the pass through region 206 and an outside diameter in the case of the bar 404. As the depressions 406 rotate through the upper sump region 222, toner drops into the depressions and is carried to the lower sump region 204 during the rotation. In one embodiment, the meter depressions 406 are positioned vertically downward when not in rotation to ensure the toner within the openings exits and to prevent toner from entering and becoming jammed. Depressions 406 are sized to transfer a specified amount of toner and may have smooth, non-abrasive inner surfaces to facilitate dumping the toner into the lower sump region 204. The central axle 410 extends from the meter gear 402 through the toner cartridge as illustrated in FIG. 6. The axle 410 may be mounted within the developer housing 220 opposite the meter gear 402 or may extend through an aperture in the developer housing.

The toner sensor mechanism 500 is positioned in the lower sump region 204 as illustrated in FIG. 5. The toner sensor mechanism 500 determines the amount of toner within the lower sump region 204 and activates the meter mechanism 400 and toner supply mechanism 300 in the event the toner level falls below a predetermined amount. The toner sensor mechanism 500 includes a sensor paddle 506 and attached cam mechanism 508, and a drive gear 502 with slideably attached pawl 504.

The drive gear 502 includes teeth 516 extending about the gear circumference as illustrated in FIGS. 5-8. An input gear 510 intermeshes with the drive gear teeth 516 providing rotation to the drive gear. As illustrated in FIG. 6, the drive gear 502 is on the same plane as the input gear 510 and outer toner supply gear 302.

The cam mechanism 508 is aligned in front of the drive gear 502 as illustrated in FIGS. 5-7. The cam mechanism 508 is attached to a central axle 526 that extends through the toner sensor mechanism and is connected to the sensor paddle 506. The cam mechanism further includes a cam profile 520 having a first end 524 less distant from the central axle 526 than the second end 522.

As illustrated in FIG. 8, posts 530 extend outward from the face of the drive gear 502 towards the cam mechanism 508 for mounting the pawl 504. The pawl 504 may be mounted between the drive gear 502 and the cam mechanism 508, however, other locations are acceptable for positioning the pawl. The pawl 504 includes two elongated openings 532 (FIG. 8) to receive posts 530 and allow the pawl to slide within the openings relative to the cam mechanism. A boss 534 (FIG. 8) extends outward from the pawl 504 and is positioned within the cam profile 520.

The sensor paddle 506 is positioned within the lower sump region 204 to the central axle 526 as best illustrated in FIG. 8. The sensor paddle 506 includes a paddle arm 527 and paddle face 540. The paddle face 540 is weighted such that the center of gravity is off-set from the central axle 526.

The sensor paddle 506 and cam mechanism 508 are connected together to rotate at the same speed and orientation. Both are freely rotated by the drive gear 502 defined as providing a rotational force for moving the sensor paddle 506 and cam mechanism 508 from a toner rest point to a fall point at an upper portion of the paddle revolution. However, both the sensor paddle 506 and cam mechanism 508 may rotate at a faster speed during an angular displacement portion of the revolution from the fall point to the toner rest point due to the offset weighting of the paddle. By way of example, when the sensor paddle 506 is positioned at an upper position within the revolution, the offset weighting of the sensor paddle 506 provides for the sensor paddle 506 and cam mechanism 508 to freely rotate ahead or fall forward of the drive gear 502 until the sensor paddle 506 contacts the toner within the lower sump region 204. At the point of rest with the toner, both the cam mechanism 508 and the sensor paddle 506 will lie substantially motionless until the drive gear 502 rotates to the position, or "catches up". At this point, the drive gear 502 will provide a force to rotate the elements through the remainder of the revolution. In one embodiment, the fall point is just beyond the top dead-center point of the revolution, however, other fall positions on the revolution may also be used for determining the angular rotation of the paddle.

An extension 528 can be positioned essentially opposite the sensor paddle 506 to delay the falling of the sensor paddle 506 when the toner level in the lower sump 204 is high. Extension 528 is positioned essentially opposite the offset weight of the sensor paddle 506 and drags in the toner just before the sensor paddle 506 gets to the fall position. When the toner level in the lower sump 204 is high, the force of the toner on the paddle extension 528 delays the fall of the sensor paddle 506. A delay in falling, when the toner level is high, allows the pawl 504 to travel past the dog leg 314 before the pawl 504 can be lifted by the falling sensor paddle 506, thus preventing an unnecessary toner addition cycle. As the drive gear 502 "catches up" to the cam mechanism 508, the pawl 504 is reset to the initial position. This process is continued for each revolution of the sensor paddle 506 and cam mechanism 508.

FIG. 8 illustrates the function of the toner sensor mechanism 500. The toner levels within the lower sump region 204 are illustrated by dotted lines 604 demonstrating a greater amount of toner and line 602 demonstrating a lesser toner amount. The drive gear 502 continuously rotates in the direction indicated by arrow 600 in FIG. 8 due to the intermeshing of the input gear 510, thereby pushing the sensor paddle 506 and cam 508 through continuous revolutions. After the sensor paddle 506 is driven to the fall point, the offset weight of the paddle results in the paddle and cam mechanism rotating faster than the drive gear 502. The sensor paddle 506 will fall ahead of the rotation of the driven gear until the sensor paddle face 540 is stopped by the toner within the lower sump region 204. Once the sensor paddle 506 stops falling, the drive gear 502 catches up to the sensor paddle 506 and cam mechanism 508 and rotates through the complete revolution.

As the cam mechanism 508 rotates in the direction illustrated by arrow 606, the cam profile 520 pushes the pawl boss 534 radially inward towards the central axle 526. This movement results in the elongated openings 532 sliding along the posts 530 and pawl end 531 moving radially outward from the center of the pawl.

Figure 9:
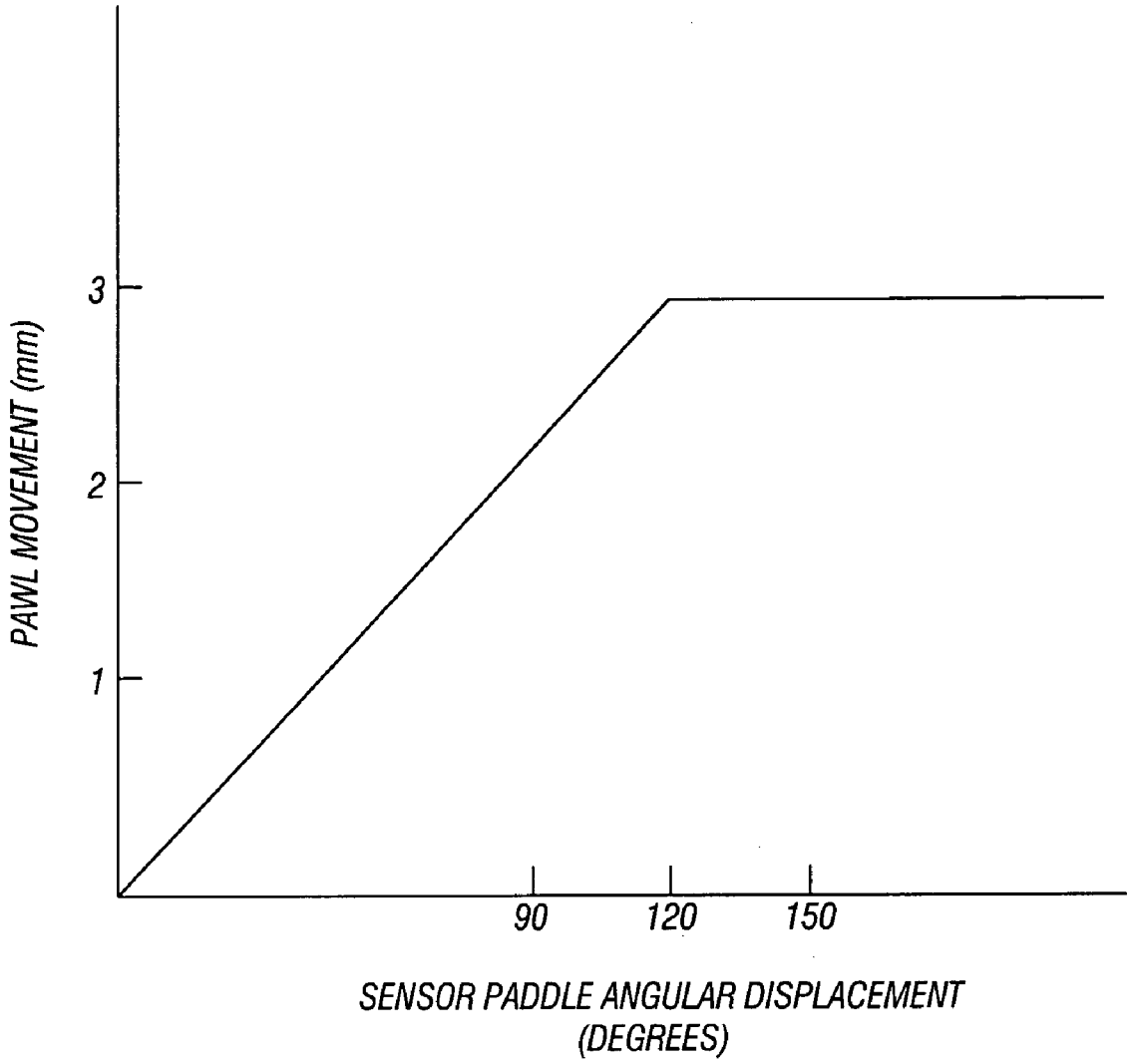
FIG. 9 is a graph illustrating the movement of the pawl relative to the angular displacement of the sensor paddle.

The larger the angular displacement of the sensor paddle 506 from the fall point to the toner rest point, the further the cam mechanism and cam profile pushes pawl end 531 radially outward from the central axle 526. FIG. 9 illustrates the pawl movement relative to the angular displacement of the sensor paddle 506. The pawl movement is dictated by the dimensions of the cam profile 520. In the embodiment illustrated in FIG. 9, the pawl begins to radially move outward upon any angular displacement of the sensor paddle 506 ahead of the driven gear. At an angular displacement of about 120 degrees relative to fall point, the pawl displacement is maximized. It will be understood by one of skilled in the art that the amount of pawl movement and degree of angular displacement can be adjusted depending upon the specific parameters of the printer.

The pawl 504 is driven by the cam mechanism 508 into contact with the dogleg 314 of the outer toner supply gear 302 to move toner from the upper sump region 222 to the lower sump region 204. As illustrated in FIGS. 6 and 7, the pawl 504 is within the same plane as the dog leg 314 to provide for contact upon a predetermined amount of pawl movement relative to the cam 508.

As illustrated in FIG. 8, the outer toner supply gear 302 is positioned relative to the drive gear 502 such that the opening 320 in the teeth of the outer toner supply gear is adjacent to the drive gear teeth 516. Rotation of the drive gear 502 does not translate to the outer toner supply gear 302 because the opening 320 does not provide for the teeth of the two gears to intermesh and the dog leg 314 is positioned above the edge of the drive gear teeth.

When an adequate amount of toner is supplied within the lower sump region such as that illustrated by toner level line 604, the amount of angular displacement of the sensor paddle 506 results in a minimal amount of radial movement of the pawl. Thus, there is no contact when the pawl end 531 rotates past the dog leg 314. As the printer 100 continues to print images, the amount of toner passed between the developer roll 124 and doctor blade 210 reduces the toner level. Eventually, the toner level will decrease to a level such as that illustrated by line 602. At this position, the sensor paddle 506 will have an angular displacement ahead of the driven gear an adequate amount resulting in the pawl end 531 contacting the dog leg 314.

As the pawl end 531 contacts the dog leg 314, the pawl transfers rotation to the outer toner supply gear until the drive gear teeth 516 mesh with the outer toner supply gear teeth 316. This results because the drive gear 502 and the outer toner supply gear 302 are positioned within the same plane as illustrated in FIG. 6. The continuous rotation of the drive gear 502 will result in one complete rotation of the outer toner supply gear 302 until the opening 320 is again positioned adjacent to the drive gear teeth 316 and the process stops.

Rotation of the outer supply gear 302 translates to rotation of the inner supply gear 304. Rotation of the inner supply gear 304 results in rotation of the meter gear 402. The toner meter depressions 406 are positioned away from the upper sump region 202 when not rotating to prevent toner from entering the depressions and possibly becoming packed within and stuck in the depressions. During rotation of the meter gear 402, the depressions rotate through the upper sump region 222 and gather toner. In this embodiment the meter depressions 406 face into the upper sump region 222 when the toner supply paddle 306 is positioned directly adjacent the depressions 406 to ensure an adequate amount of toner enters the openings. Upon rotation of the meter gear 402, the toner within the depressions 406 is discharged via gravity or other means into the lower sump region 204. One rotation of the outer toner supply gear 302 may result in more than one rotation of the meter gear 402. By way of example as illustrated in FIG. 5, one rotation of the outer toner supply gear 302 results in one rotation of the meter gear 402 and, thereby one toner load being moved from the upper sump region 222 to the lower sump region 204. The correlation between size of the gears and the number of rotations of the depressions 406 will vary depending upon the parameters of the printer. In one embodiment, upon complete rotation of the outer toner supply gear 302, the depressions 406 are in a downward facing position to allow for all the toner to exit the depressions.

Once the outer toner supply gear 302 completes a full rotation and the opening 320 is positioned adjacent to the drive gear 502, there may be teeth chatter resulting from the drive gear teeth 516 contacting the last tooth on the toner supply gear 302. To prevent this chatter, in one embodiment at least one tooth 417 on the drive gear 502 has a greater length than the other teeth to push the last tooth of the toner supply gear 302 beyond the contact with the gear teeth 516. The large tooth 417 only moves the last tooth of 302 a small distance still allowing for the pawl 504 to contact the dog leg when additional toner is required in the lower sump region 204. A back check can also be used to prevent gear 302 from traveling back into contact with drive gear 502.

This process of adding toner as needed to the lower sump region 204 continues until all the toner within the cartridge is consumed. At that point, a new cartridge is required. In one embodiment, the toner within the lower sump region is transferred to the photoconductor 114 before the additional toner is added from the upper sump region 204. This first in-first out format has proven effective in maintaining good print quality. Also, the toner sensor mechanism 500 is calibrated such that additional toner is transferred to the lower sump region 204 prior the occurrence of print defects or other quality problems.

Figure 10:
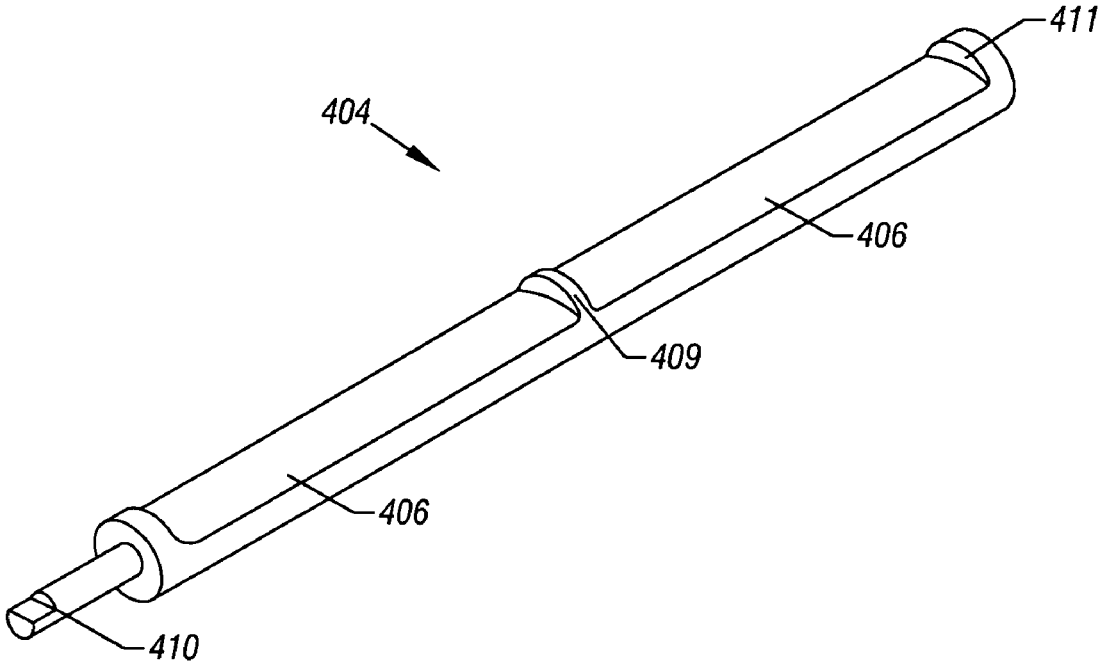
FIG. 10 is a perspective view of the metering bar according to one embodiment.

Referring to FIG. 10, the configuration of the metering bar 404 is depicted. The metering bar 404 may be rotated through its central pin 410 which may be engaged and rotated by the meter gear 402. Rotation of the metering bar 404 causes the depressions 406 to face upwardly to receive toner or downwardly to dispense toner. Because of the convex shape of the depressions 406, as shown in FIGS. 10, 4, and 5, the shape of the depressions tends to reduce the tendency of toner to stick within the depressions 406.

As used herein, "convex" means "bowed radially outwardly" and encompasses flat and curved outwardly bowed surfaces, and outwardly bowed surfaces that are or are not symmetrical about the axis of bar 404 rotation, as well as shapes that include more complex and/or multiple, protruded surfaces. In one embodiment, the convex shape is elongate along the axis of rotation of the bar 404 while curving gently.

Particularly with chemically polymerized toner, the toner may tend to stick or adhere to the metering bar 404. Because of the convex shape defined by the depressions 406 in the metering bar 404, the toner is actually physically urged to drop from the metering bar 404. This reduces the tendency of the toner to stick therein.

In the foregoing description, like-reference characters designate like or corresponding parts throughout the several views. Also, it is to be understood that such terms as "forward", "rearward", "left", "right", "upwardly", "downwardly", and the like are words of convenience that are not to be construed as limiting terms. Certain modifications and improvements will occur to those skilled in the art upon a reading of the foregoing description. It should be understood that all such modifications and improvements have been deleted herein for the sake of conciseness and readability but are properly within the scope of the following claims.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A toner cartridge comprising:

an upper toner region;

a lower toner region;

a pass through region between said upper and said lower toner regions; and a metering bar rotatable on an axis of rotation within said pass through region, said bar including a convex depression formed therein, said convex depression having a surface that is bowed radially outwardly relative to said axis of rotation.

2. The cartridge of claim 1 wherein said metering bar includes two or more spaced convex depressions along its length, and wherein each of said two or more spaced convex depressions has a surface that is bowed radially outwardly relative to said axis of rotation.

3. The cartridge of claim 1 wherein said pass through region is cylindrical and journals said metering bar so as to define a pocket between the bar and said pass through region for holding toner.

4. The cartridge of claim 3 including a cylindrical metering bar.

5. The cartridge of claim 1 including chemically polymerized toner.

6. A method comprising:

rotating on an axis of rotation a metering bar within a pass through region between an upper and lower toner reservoir; and collecting toner in a convex depression in said bar on a surface that is bowed radially outwardly relative to said axis of rotation.

7. The method of claim 6 including collecting toner in two or more spaced depressions each having a convex surface that is bowed radially outwardly relative to said axis of rotation.

8. The method of claim 6 including rotating said bar within a cylindrical pass through region having a diameter substantially equal to the diameter of said bar.

9. The method of claim 8 including journaling said bar in said region to dispense a fixed amount of toner from said upper to said lower reservoir.

10. The method of claim 6 including metering a chemically polymerized toner.

11. An image-forming apparatus comprising:

a toner reservoir having upper and lower chambers and a pass through region between said chambers;

a metering bar rotatable on an axis of rotation within said region, said bar including a convex toner-conveying depression having a surface that is bowed radially outwardly relative to said axis of rotation;

a developer roll to receive toner from said reservoir; and a photoconductor to receive toner from said roll.

12. The image-forming apparatus of claim 11 wherein said metering bar includes two or more spaced convex depressions along its length, and wherein each of said two or more spaced convex depressions has a surface that is bowed radially outwardly relative to said axis of rotation.

13. The image-forming apparatus of claim 11 wherein said pass through region is cylindrical and journals said metering bar so as to define a pocket between the bar and said pass through region for holding toner.

14. The image-forming apparatus of claim 13 including a cylindrical metering bar.

15. The image-forming apparatus of claim 11 including chemically polymerized toner.

16. The apparatus of claim 11 in the form of a printer.

17. The apparatus of claim 11 including a toner cartridge including said toner reservoir.

18. The cartridge of claim 1, wherein said surface bowed radially outwardly of said convex depression is elongate along said axis of rotation.

19. The image-forming apparatus of claim 11, wherein said surface bowed radially outwardly of said convex toner-conveying depression is elongate along said axis of rotation.

* * * * *